United States Patent [19]

Koike et al.

[11] Patent Number: 4,973,175

[45] Date of Patent: Nov. 27, 1990

[54] ELECTRONIC PRINTING APPARATUS

[75] Inventors: Seiji Koike, Shizuoka; Takeshi Tashiro, Mishima; Osamu Koizumi, Shizuoka; Toshiharu Shimosato, Shizuoka; Kazuhiro Fushimi, Mishima, all of Japan

[73] Assignee: Tokyo Electric Co., Ltd., Tokyo, Japan

[21] Appl. No.: 448,768

[22] Filed: Dec. 11, 1989

[30] Foreign Application Priority Data

Dec. 15, 1988 [JP] Japan ..... 63-162673[U]

[51] Int. Cl.[5] ..... B41J 29/13

[52] U.S. Cl. ..... 400/693; 312/208

[58] Field of Search ..... 400/690.4, 693, 694; 312/208, 283, 284, 289, 290

[56] References Cited

U.S. PATENT DOCUMENTS 4,294,496 10/1981 Murez ..... 312/208

4,425,014 1/1984 Blepp ..... 312/284

4,449,763 5/1984 Barnett ..... 400/691

*Primary Examiner*—Edgar S. Burr

*Assistant Examiner*—Ren Yan

*Attorney, Agent, or Firm*—Frishauf, Holtz, Goodman & Woodward

[57] ABSTRACT

An electronic printing apparatus comprises a printer body having a front surface with a window, a sheet feeding mechanism provided in the printer body, which may be accessed for maintenance work through the window, a main front cover for opening and closing the window in the front surface of the printer body, a sub-front cover movably provided on the printer body so as to be downwardly pivotable about the bottom of the printer body in a perpendicular direction, and having an operation surface which covers the main front cover so that it faces thereto, and a keyboard and a display provided on the operation surface of the sub-front cover.

5 Claims, 1 Drawing Sheet

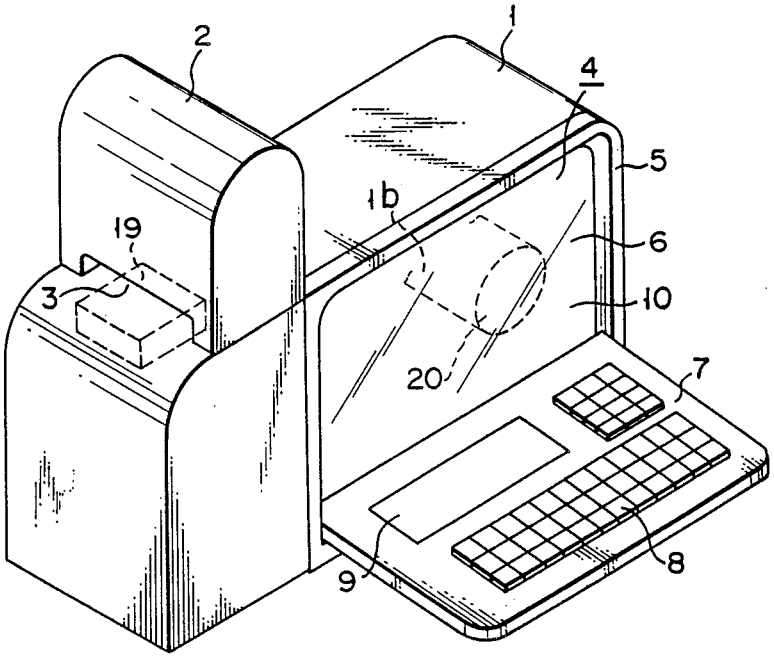
2
1
4
5
1b
19
6
3
10
20
7
9
8

ELECTRONIC PRINTING APPARATUS

BACKGROUND OF THE INVENTION

1. Field of the Invention

The present invention relates to an electronic printing apparatus comprising a printer body incorporating a printing mechanism therein, and a cover which has a keyboard on one surface and is movably provided to the printer body.

2. Description of the Related Art

In a conventional printing apparatus of this type, the keyboard cover is overlapped on the printer body so that the keyboard faces the printer body when the apparatus is not used, to protect the keyboard from dust. To use the apparatus, the cover is detached from the printer body or swung into an open position, so that the keyboard surface is set upward, and the keyboard can be operated to input data.

To change sheet in the printing mechanism, for example, it is necessary to open a body cover provided on the top or the side surface of the printer body in order to gain an access to the inside of the printer body. In order to open the body cover for this purpose, an operator must stand up or change his or her position. In other words, the operator cannot change sheet in the sitting position in which he or she operates the keyboard. Hence, sheet-changing or any other similar maintenance work carried out in the course of a data-input operation is troublesome. In addition, since a sufficiently large space must be provided around the printer body for opening the body cover, the printing apparatus cannot be situated at a limited space.

SUMMARY OF THE INVENTION

It is accordingly an object of the present invention to provide an electronic printing apparatus whose printing mechanism can be easily accessed for maintenance work during a data-input operation, and which does not require much space for such maintenance work.

The electronic printing apparatus of the present invention comprises:

- a printer body having a front surface with a window;
- a sheet feeding mechanism provided in the printer body, which may be accessed through the window;
- a main front cover for opening and closing the window in the front surface of the printer body;
- a sub-front cover movably provided on the printer body, and having an operation surface with covers the main front cover so that it faces thereto; and
- a keyboard provided on the operation surface of the sub-front cover.

BRIEF DESCRIPTION OF THE DRAWINGS

FIGURE is a perspective view showing an electronic printing apparatus according to an embodiment of the present invention.

DETAILED DESCRIPTION OF THE PREFERRED EMBODIMENTS

An electronic printing apparatus according to an embodiment of the present invention will be described with reference to the accompanying drawing. In the FIGURE, reference numeral 1 denotes a printer body incorporating a conventional printing mechanism 19 comprising a platen and a thermal head. Printer body 1 has a head cover 2 housing the printing head, and a base provided with the platen and a sheet feeding mechanism 20. On one side of head cover 2 is formed sheet discharging port 3 for discharging printed sheet. Reference numeral 4 denotes a main front cover for opening and closing window 1*b* formed in the front surface of printer body 1. Main front cover 4 is pivotally connected to printer body 1 via fulcrums (not shown) at its bottom, so that it can swing 90° about a horizontal axis between a closed position and an open position. When main front cover 4 is in a closed position, the inside of the printer body is covered, and when in an opened position, the inside elements such as said sheet feeding mechanism 20 can be accessed for maintenance work. Main front cover 4 includes a rectangular frame 5 and a transparent plate 6 surrounded thereby and connected to the inner peripheral wall thereof. Frame 5 protrudes forward from transparent plate 6, thus forming a concavity 10 in front of cover 4. Further, a sub-front cover 7 is pivotally connected to printer body 1 via main front cover 4. More specifically, sub-front cover 7 is pivotal on a horizontal axis with respect to frame 5, and can be set in concavity 10 formed in front of main front cover 4 when folded. Needless to say, sub-front cover 7 may be pivotally connected directly to printer body 1. Keyboard 8 and display 9 are arranged on one surface of sub-front cover 7.

Though not shown in the drawing, printer body 1 has a clamp at the upper edge of the window, which can be engaged with the upper edge of main front cover 4, and main front cover 4 has a clamp at the upper edge of frame 5, which can be engaged with sub-front cover 7. These clamps ensure the secure closure of covers 4 and 7.

In the printing apparatus thus arranged, when the apparatus is operated, the window of printer body 1 is closed by main front cover 4, and sub-front cover 7 is swing by 90° as shown in the FIGURE, so that an operator can operate keyboard 8 while watching display 9. When a printing mode is selected via keyboard 8 and the execution key is depressed, the printing operation starts and printed sheet is discharged from sheet discharging port 3. In the case of an exchange of ink ribbons, resupplying of paper, or maintenance of the printer body, main front cover 4 is pivoted in the opening direction so as to expose the inside elements of the printer body. On the other hand, when the printer apparatus is not operated, main front cover 4 can be pivoted in the closing direction so as to close the window of printer body 1. Further, sub-front cover 7 is pivoted upward so that keyboard 8 and display 9 face main front cover 4. In this state, keyboard 8 and display 9 are sandwiched between main front cover 4 and sub-front cover 7, and protected by these covers. In addition, since housing section 10 for housing keyboard 8 and display 9 is formed, sub-front cover 7 does not protrude from the front surface of printer body 1.

According to the present invention a described above, a housing section for housing the keyboard and the display can be easily formed between the main front cover and the sub-front cover. Moreover, when the keyboard and the display are used with the sub-front cover open, the window of the printer body is closed by the main front cover, thereby protecting the inside elements. Further, when the apparatus is not used, the display and the keyboard are protected by the sub-front cover and the main front cover.

We claim:

1. An electronic printing apparatus comprising:

a printer body having a front surface with a window;

a sheet feeding mechanism provided in the printer body, which may be accessed for maintenance work through the window;

a main front cover for opening and closing the window in the front surface of the printer body;

a sub-front cover movably provided on the printer body, and having an operation surface which covers the main front cover so that it faces thereto; and a keyboard provided on the operation surface of the sub-front cover.

2. The electronic printing apparatus according to claim 1, wherein said sub-front cover is provided on said printer body so as to be downwardly pivotable about the bottom of said printer body in a perpendicular direction, and said operation surface is set upward when said sub-front cover is pivoted.

3. The electronic printing apparatus according to claim 1, which includes a display provided in the operation surface of the sub-front cover.

4. The electronic printing apparatus according to claim 1, wherein said main front cover has a front surface which is to face the operation surface of said sub-front cover, and a recess formed in the front surface in which said sub-front cover is to be set.

5. The electronic printing apparatus according to claim 4, wherein said main front cover includes a frame positioned in said window, extending along the periphery of the window and having an inner peripheral wall, and a transparent plate having said front surface and surrounded by the frame, whose periphery is attached to inner peripheral wall of the the frame, said frame protruding from the front surface of said transparent plate so that the inner peripheral wall of said frame and said transparent plate defining said recess.

* * * * *